United States Patent [19]

Hutton et al.

[11] 4,033,059

[45] July 5, 1977

[54] DOCUMENTS OF VALUE INCLUDING INTAGLIO PRINTED TRANSITORY IMAGES

[75] Inventors: Robert Gordon Hutton, Ashton; Trevor Merry, Ottawa, both of Canada

[73] Assignee: American Bank Note Company, New York, N.Y.

[22] Filed: Apr. 18, 1975

[21] Appl. No.: 569,563

Related U.S. Application Data

[63] Continuation of Ser. No. 278,980, Aug. 9, 1972, abandoned.

[30] Foreign Application Priority Data

July 6, 1972 Canada ..... 146533

[52] U.S. Cl. ..... 40/137; 101/150; 283/8 B; 427/7; 428/30; 428/916

[51] Int. Cl.[2] ..... G09F 7/16

[58] Field of Search ..... 40/137; 283/8 R, 8 B; 428/187, 915, 916, 29, 30; 427/7; 101/150

[56] References Cited

UNITED STATES PATENTS

| | | | |
|---|---|---|---|
| 993 | 7/1860 | Albro | 428/30 |
| 734,135 | 7/1903 | Porter | 428/30 |
| 1,002,600 | 9/1911 | Morris et al. | 283/8 B |
| 1,114,346 | 10/1914 | Farmer | 283/8 R |
| 1,996,539 | 4/1935 | Dufay | 428/30 |
| 2,313,489 | 3/1943 | Latrobe | 40/137 X |
| 2,850,825 | 9/1958 | Grants | 40/137 |
| 3,471,172 | 10/1969 | Bayha | 283/8 R |

FOREIGN PATENTS OR APPLICATIONS

| | | | |
|---|---|---|---|
| 327,924 | 4/1903 | France | 40/137 |
| 932,785 | 12/1947 | France | 428/30 |
| 438,236 | 11/1935 | United Kingdom | 40/137 |
| 337,924 | 11/1930 | United Kingdom | 428/29 |

*Primary Examiner*—Clyde I. Coughenour
*Attorney, Agent, or Firm*—Cooper, Dunham, Clark, Griffin & Moran

[57] ABSTRACT

An imprint of inked intaglio pattern elements such as lines on a document of value or the like, including background portions and readily recognizable image portions each formed by pattern elements of the imprint. The pattern elements forming the image portions differ in orientation or depth from pattern elements forming the background portion to provide variation in contrast between image and background with change in angle of view of the document, the pattern elements being so arranged that the image blends visually with the background from one angle of view but appears as a readily recognizable symbol in clear contrast to the background from another angle of view.

22 Claims, 20 Drawing Figures

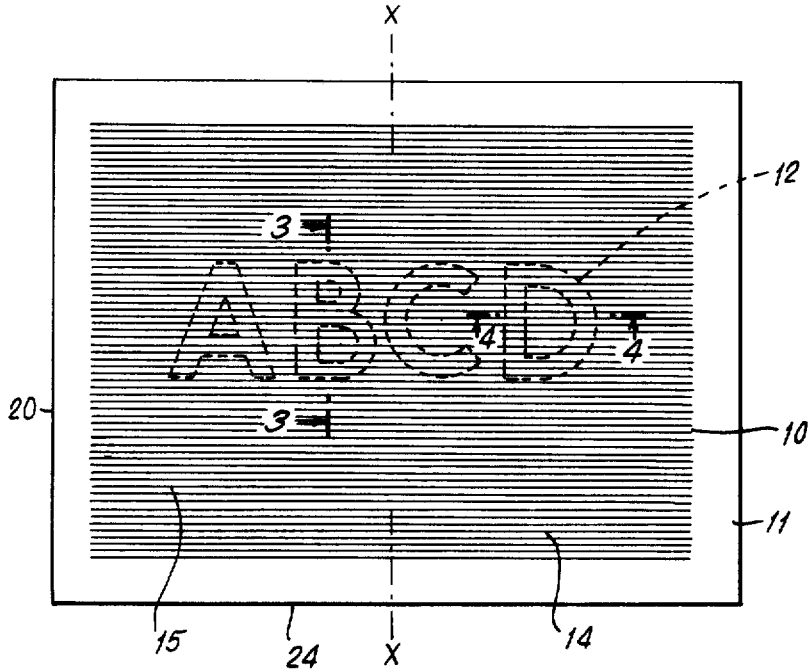
Fig. 1.
Fig. 2.
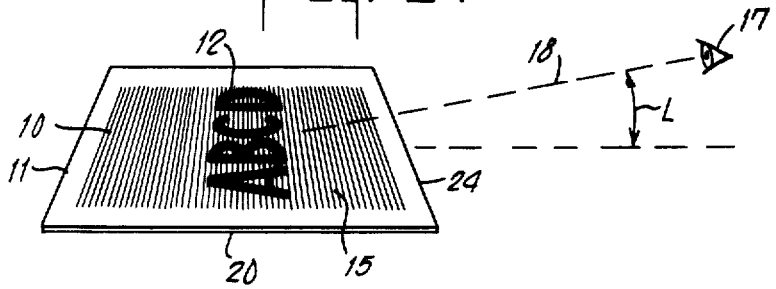
Fig. 3.
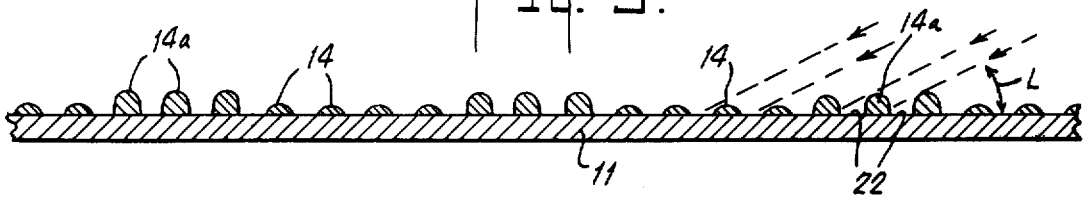
Fig. 4.
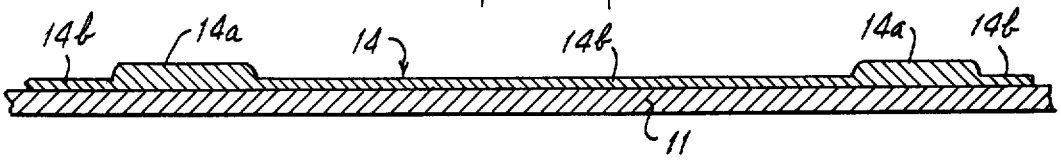

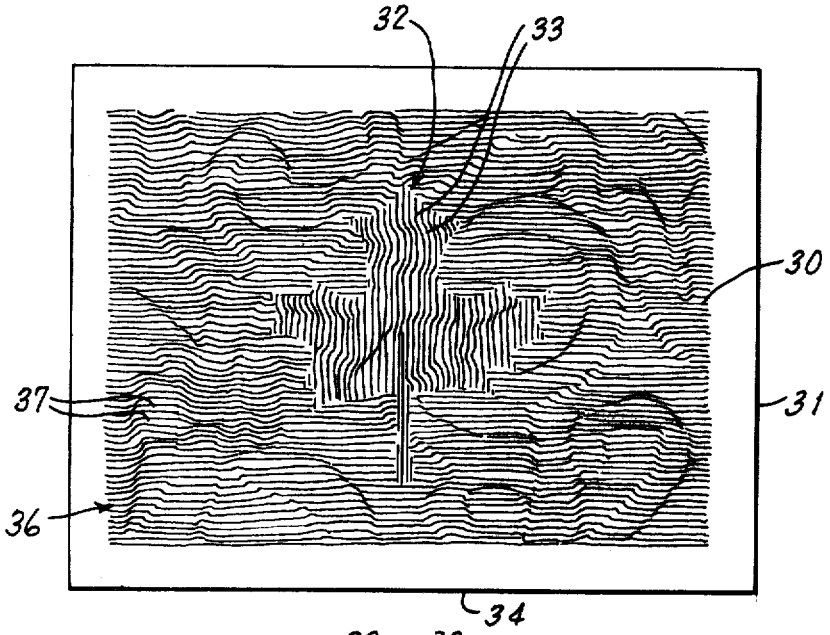
Fig. 5.
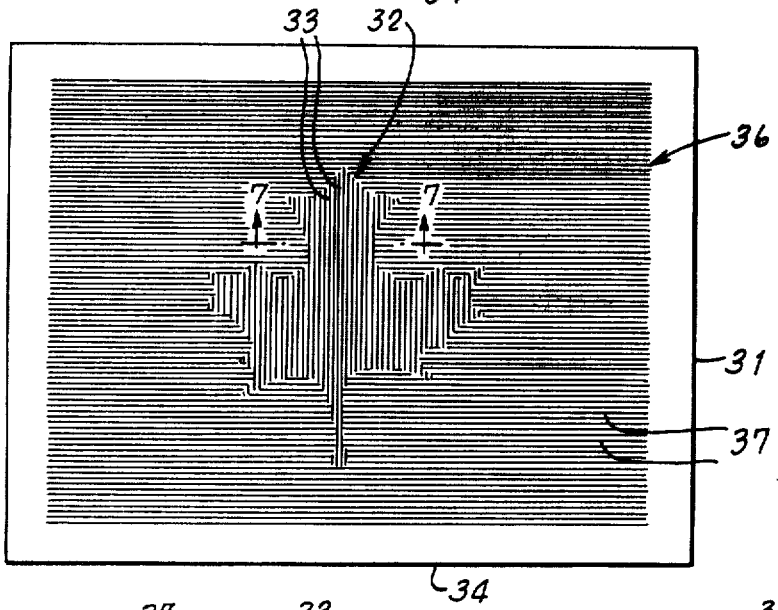
Fig. 6.
Fig. 7.
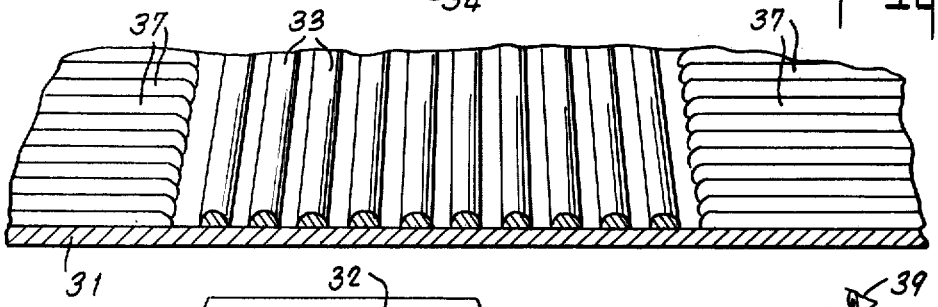
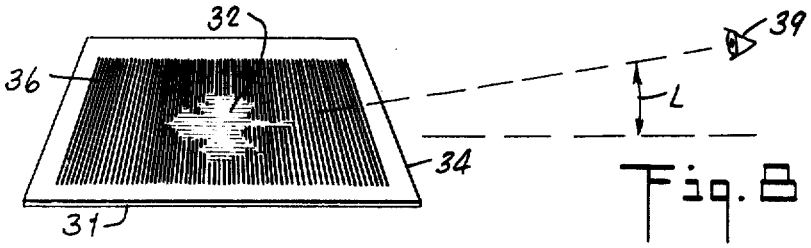
Fig. 8.

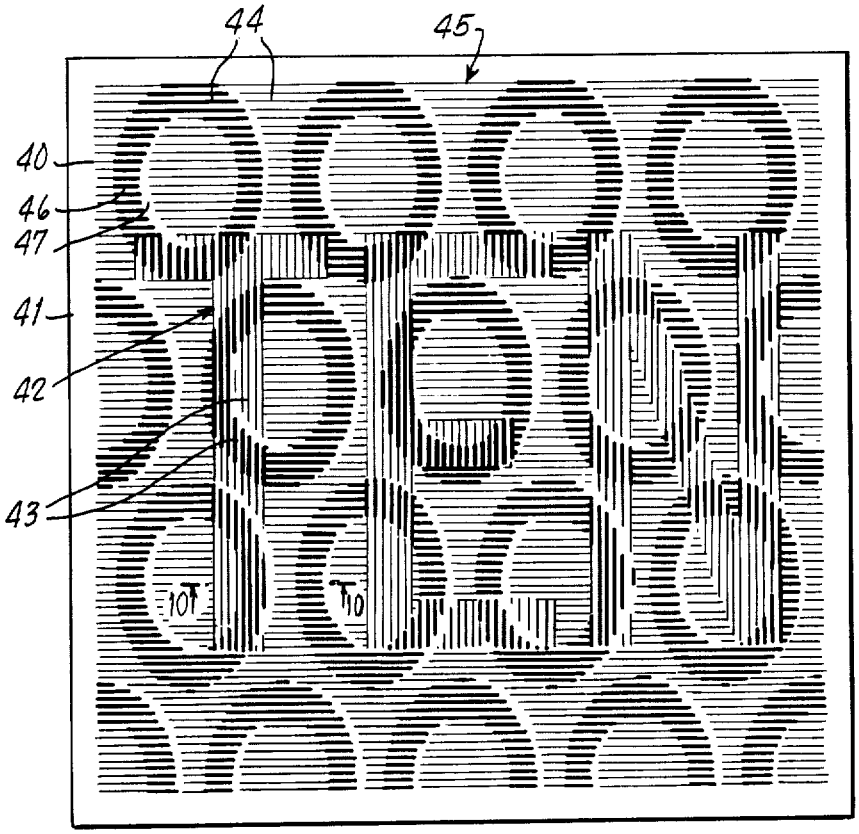
Fig. 9.
Fig. 10.
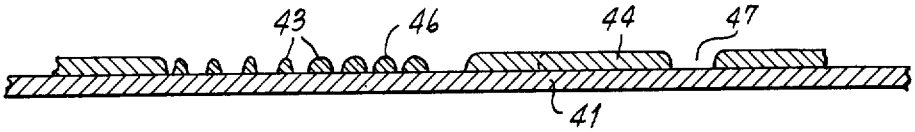
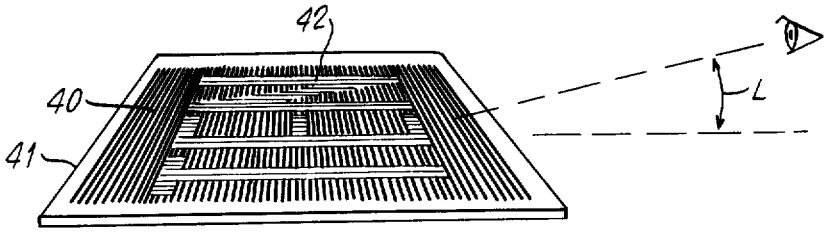
Fig. 11.

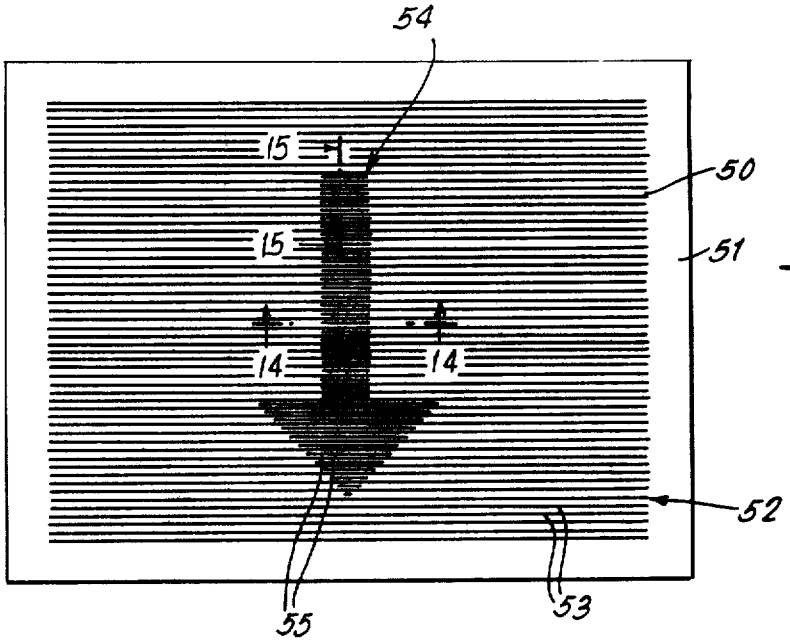
Fig. 12.
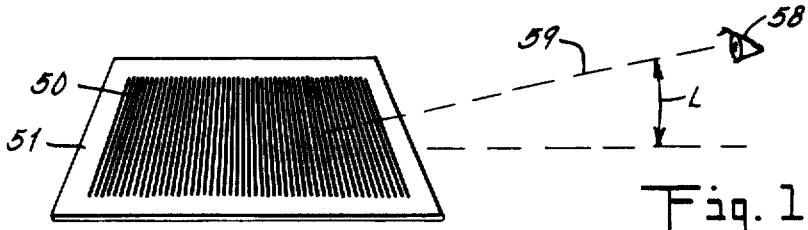
Fig. 13.
Fig. 14.
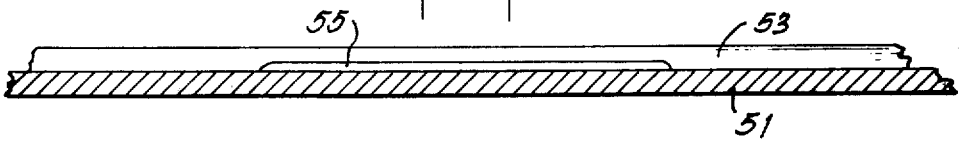
Fig. 15.
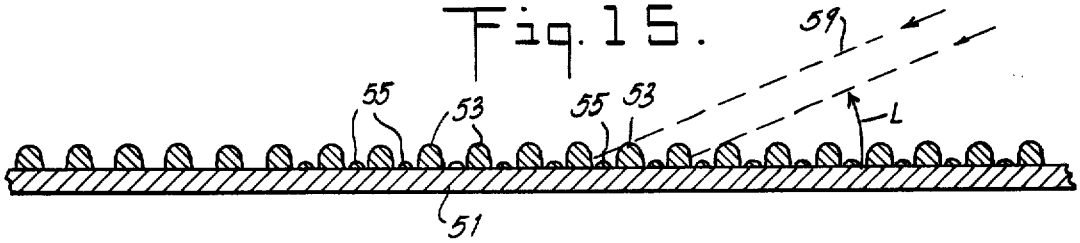

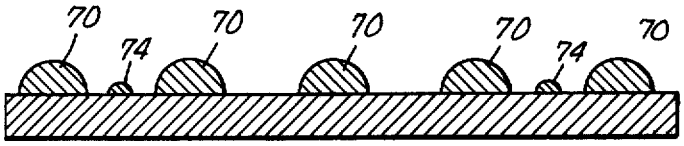
Fig. 18.
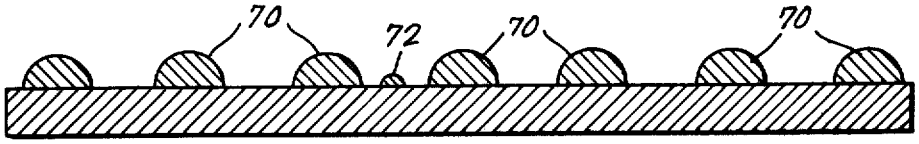
Fig. 19.
Fig. 20.
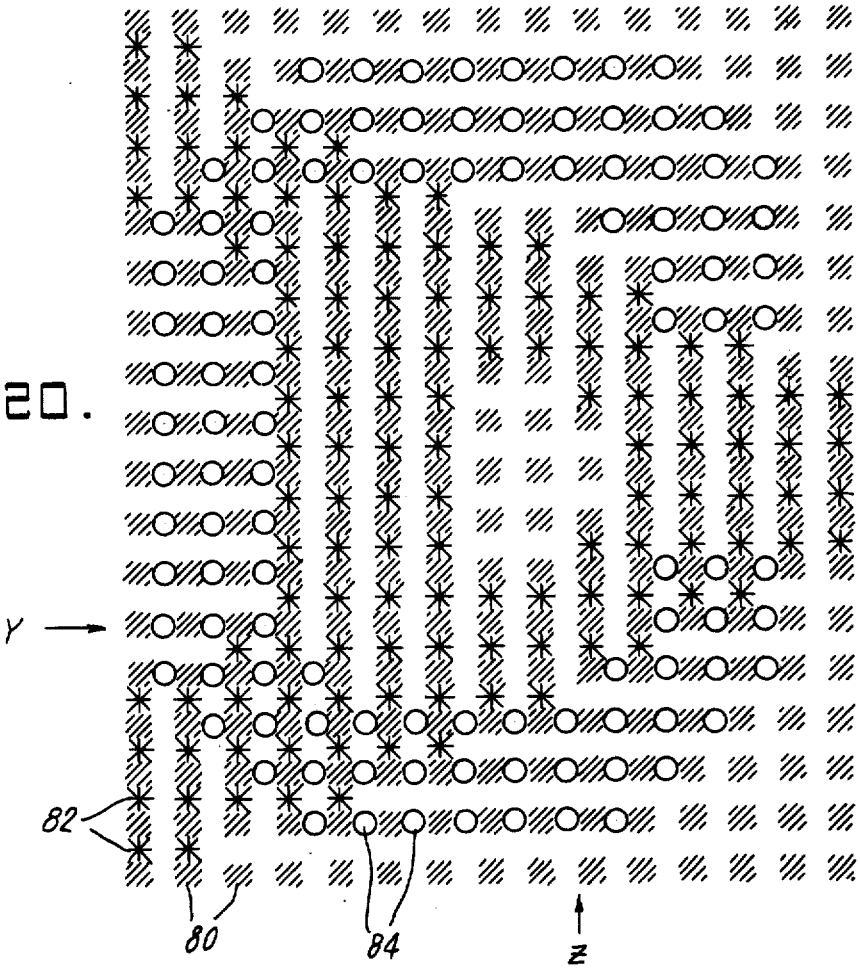

DOCUMENTS OF VALUE INCLUDING INTAGLIO PRINTED TRANSITORY IMAGES

CROSS REFERENCE

This application is a continuation of my copending application Ser. No. 278,980, filed Aug. 9, 1972, now abandoned, entitled "Formation of Transitory Images by Intaglio Printing".

BACKGROUND OF THE INVENTION

This invention relates to printed matter, and especially to printed matter having imprints adapted to enable prevention or detection of fraud, i.e., counterfeits. In a more particular sense, the invention is directed to documents of value including new and improved intaglio imprints which resist counterfeiting, and to means and methods for producing such imprints.

Intaglio printing is widely employed for the production of documents of value such as bonds, bank notes, stock certificates and other papers as to which it is desired to prevent counterfeiting or enable detection of counterfeits. An intaglio imprint is obtained by pressing a suitable recording medium e.g., paper, against an engraved and inked plate so as to deform the medium into ink-bearing engraved recesses of the plate. The resultant impression, constituting a pattern formed of spaced and raised inked lines and/or other pattern elements, is characterized by superior clarity and sharpness of appearance, and cannot readily be copied with sufficient fidelity to escape expert detection.

Especially as produced with the aid of modern photographic copying techniques, however, counterfeits of intaglio-printed documents may be adequately authentic in appearance to escape detection upon cursory inspection by inexpert personnel; yet in many instances where detection of counterfeits is important, it is impracticable to subject documents to detailed or expert scrutiny. Therefore, in order to enhance the protection against counterfeits intended to be achieved by intaglio printing, it is desirable to provide means whereby relatively untrained persons can quickly and positively distinguish authentic intaglio-printed documents from photographic copies or like counterfeits, without the use of screens, special lights or other mechanical devices.

Some alternative expedients heretofore proposed for prevention or detection of counterfeits have involved provision, on a substrate such as paper, of a transitory image, i.e., an image that can be made to appear or disappear upon performance of certain operations.

Specifically, it has been proposed (e.g., Morris et al, U.S. Pat. No. 1,002,600) to provide a flat surface-printed pattern including an image which is formed of closely spaced parallel lines and is surrounded by a background of differently-oriented parallel lines of like shade so that the image is ordinarily difficult to distinguish from the background; for detection of the image, a screen bearing similar parallel lines is superimposed on the imprint in alignment with either the image lines or the background lines. It has also been proposed, e.g., in Dow U.S. Pat. 1,428,278, to print an image and surrounding background in different inks which are indistinguishable from each other in ordinary light but display a contrasting appearance when illuminated with light of particular colors. The production of transitory images by the use of lenticular screens, especially for purposes of amusement or artistic design, is well known, e.g., in Rice et al, U.S. Pat No. 3,241,429. Taylor, U.S. Pat. No. 1,990,421, proposed to impress an appropriately oriented pattern of embossed ridges on a substrate bearing a flat surface-printed pattern for production of decorative transitory variegated visual effects when the superimposed patterns are viewed at an angle at which the embossed ridges partially obscure the printed pattern.

Bayha, U.S. Pat No. 3,471,152 prints an intaglio pattern of parallel lines in ink having low contrast with the paper, e.g., white on white. He then detects the invisible pattern by an elaborate scanning apparatus (U.S. Pat. Nos. 3,457,421 and 3,462,225) which depend upon the absorption of electromagnetic radiation by his printed lines.

Expedients of the foregoing types, however, present either difficulties in Fabrication, e.g., owing to problems of maintaining precise register during successive printing and forming steps, or difficulties in use, because they necessitate provision of auxiliary detecting devices such as special lights or screens. Even apart from these considerations, such expedients are not widely acceptable as substitutes for visible intaglio printing in security paper, for a variety of reasons including the marked superiority in quality of appearance afforded by intaglio printing, and the strongly established preference for intaglio printing in this field.

SUMMARY OF THE INVENTION

The present invention broadly contemplates the provision of an intaglio imprint incorporating, as a part of the imprint itself, a transitory image, sensitive to changes in the viewing angle, whose transitory character is readily visually detectable by untrained personnel, and which is incapable of being copied so as to exhibit a transitory character, in a photographic or like reproduction of the imprint.

More specifically, the invention contemplates the provision of an article suitable for use as a security document or the like, including the combination of a recording medium having an intaglio-printable surface and an intaglio imprint of spaced and raised inked pattern elements on the surface, wherein the imprint includes an image and an adjacent background each formed by pattern elements thereof, and wherein pattern elements in the image differ from pattern elements in the background for producing variation in contrast between the image and the background as the angle of view of the imprint varies in at least one plane normal to the surface, the image and background pattern elements being respectively so arranged that the image substantially blends visually with the background from one angle of view but appears in clear contrast to the background from another angle of view in the aforementioned plane. The term "angle of view", as used herein, refers to the angle between the imprint-bearing surface and the line of sight from the eye of a viewer to a point on the imprint being viewed.

Each pattern element of an intaglio imprint on a substrate, e.g., paper, includes a part of the substrate which is appreciably raised above the general plane of the substrate surface bearing the imprint; furthermore, the raised imprint has a layer of ink on its upper surface. Hence, these elements have substantial depth, the term "depth" being used herein to designate the dimension of an intaglio pattern element in a direction perpendicular to the substrate surface, or in other words, the height to which such element projects above adjacent portions of the surface. Typical intaglio pattern elements include lines, dots and other shapes, the raised portions of such elements bearing ink. As one example, to which particular reference will be made herein for purposes of illustration, one known type of intaglio imprint is constituted of a large plurality of more of less parallel, spaced, raised, inked lines cooperatively defining a visible pattern formed by variations in the width, spacing and/or curvature of the lines.

When an intaglio imprint of the type just described is seen from an acute angle of view in a plane perpendicular to the lines, it is found that the inked lines (being raised, as stated, above the substrate surface) at least partially occlude the spaces between them, with the result that the imprint may appear perceptibly more intense (i.e., darker) than it does when seen from an angle of view normal to the substrate surface. Furthermore, if the acute angle of view is taken in a plane parallel to the lines, then the lines will appear lighter at that acute angle than when seen from an angle normal to the substrate surface. The extent of this occlusion and resultant enhanced intensity is dependent on line depth, line spacing, and angle of view. In particular, for a given angle of view and line spacing, lines of greater depth will more completely occlude the intervening spaces and hence appear more intense (e.g., darker) than lines of lesser depth.

The present invention uses this three-dimensional or depth property of intaglio printing to produce transitory images. In all embodiments of the invention, the intaglio printing elements are printed in an ink which contrasts with the color of the paper or other underlying substrate. Furthermore, the integlio pattern elements are arranged in two arrays. One array constitutes an image of readily recognizable form, preferably a letter, numeral, or other well known symbol or combinations of such letters, numerals or symbols. The other array is termed the background, and typically is adjacent the image array so that the background array defines the limits of the image array. The intaglio pattern elements in the background array have a uniform dimensional characteristic detectably different by visual inspection from the corresponding dimensional characteristic in the pattern elements of the background array. This characteristic may be, in the presently preferred embodiment, the orientation of the lines. In other embodiments, it may by the depth of the lines.

The difference in that characteristic are such that when the printed substrate is viewed from one preselected angle, the image array appears in an aspect in which it blends visually with the background array and can be visually distinguished from it only with difficulty. When the substrate is viewed from another preselected angle, the image array appears in a different aspect in which it stands out in clear contrast to the background array.

Since a photographic reproduction is necessarily based on a view from one angle only, it cannot reproduce both the blending aspect and the contrast aspect of the two arrays. Hence, an observer of such a reproduction can readily distinguish it from a genuine, intaglio printed document, by simply shifting it from one angle of view to the other.

In certain embodiments, the invention employs intaglio pattern elements for the readily recognizable image that differ in depth from the intaglio pattern elements constituting the background defining the limits of the image. Thus, one form of imprint in accordance with the invention may comprise a first array of intaglio pattern elements of enhanced depth constituting an image and a second array of intaglio elements, constituting the background, of lesser depth. In this case, the image thus formed blends visually with the background when the imprint is viewed from a normal angle of view; but when seen from a sufficiently acute angle of view, in at least one plane perpendicular to the imprinted substrate surface, the image appears markedly more intense than the background and is therefore clearly perceptible, because the array of relatively deeper image-forming elements appears more intense than the array of relatively less deep background-forming elements. Such an image, appearing only when the imprint is seen at an acute angle of view, is herein termed a latent image.

In another specific embodiment, the background portion of the imprint comprises a first array of deep intaglio pattern elements and the image comprises a second array of intaglio pattern elements of substantially lesser depth than the first array, the image-forming elements being interposed between elements of the background, so as to be occluded by the background-forming pattern elements when the imprint is seen at a sufficiently acute angle of view in at least one plane normal to the substrate surface. This image contrasts clearly with the background as seen from a normal angle of view, because the portions of the imprint having image-forming elements interposed between background elements appear substantially more intense (e.g., darker) than those portions of the imprint where the background elements are separated by unprinted spaces. However, as seen from a sufficiently acute angle of view in an appropriately oriented plane, the image disappears because the relatively deeper background elements completely occlude the image elements and there is no longer any contrast between different portions of the imprint. This image, visible from a normal angle of view but substantially disappearing at an acute angle of view, is herein termed a transient image.

It is also possible to provide imprints, including intaglio pattern elements, that exhibit transitory visual effects involving changes other than variation in intensity. For example, a surface-printed ground pattern in plural colors may be overprinted with inked intaglio pattern elements so aligned with the ground pattern as to selectively occlude a particular color or colors in the ground pattern when seen at a sufficiently acute angle of view in an appropriate direction. The imprint thus displays one color effect at a first (e.g., normal) angle of view, and a different color effect at a second (e.g., acute) angle of view.

In the presently preferred embodiments, the image and background of the imprint of the invention are each formed by substantially parallel intaglio pattern elements (e.g., lines) with the lines or other elements of the image oriented at a substantial angle to the lines or other elements of the background. For example (referring to the use of lines), the background and image lines may have substantially the same width and spacing, so that as seen from a normal angle of view, the image blends visually with the background. If the imprint is seen from a sufficiently acute angle of view in a plane perpendicular to the background lines, the background portion of the imprint appears substantially more intense (e.g., darker) than it does when seen from a normal angle of view, owing to the effect of the background lines in partially occluding the intervening spaces; however, the image-forming lines (being oriented at an angle to the background lines) are more nearly aligned with the viewer's line of sight, and therefore even at such an acute angle the spaces between adjacent image lines are less occluded than the spaces between adjacent background lines, with the result that the image then appears in substantial contrast to the relatively more intense background. A reverse effect is obtained at an acute angle of view in a plane perpendicular to the image lines; i.e., the image than appears markedly more intense than the background because the occluding effect of the image lines is greater than that of the background lines. Thus again, there is provided a latent image, i.e., an image clearly distinguishable only at an acute angle of view. The greatest contrast is obtained when the image lines are perpendicular to the background lines, but detectable images can be achieved at much lesser angles of divergence between the image and background lines, e.g., when the image lines diverge from the background line orientation by an angle as small as 30°.

Further in accordance with the invention, the lines or other pattern elements forming the background and image may cooperatively vary in width and/or curvature so as to define together a continuous pattern extending over the imprint and visible, e.g., from a normal angle of view, without impairing the detectability of the transitory image. That is to say, since the provision of the transitory image involves depth properties of the intaglio imprint, a transitory image of substantially unimpaired quality may be obtained even though pattern elements vary in appearance as seen from a normal angle of view. Provision of an overall visible pattern aids in concealing a latent transitory image.

While the foregoing embodiments of the invention have been described as formed of lines, other types of intaglio pattern elements may be used in place of lines to produce like transitory image effects. For example, rows of dots may be used, the rows varying in height or orientation as described, to produce transitory images. Also, while the transitory images have been described as varying in contrast with the background depending on angle of view, similar effects may be observed in documents intaglio printed as described above by varying the angle at which the imprint is illuminated, utilizing the phenomenon that when the raised intaglio pattern elements are illuminated at an acute angle, they cast shadows which produce selective apparent darkening of areas of the imprint (especially when the imprinted substrate surface of ground color is light), depending of the relative depth of the pattern elements or their orientation in relation to the direction from which the imprint is illuminated.

The foregoing embodiments of the invention may be combined or modified in various ways to produce additional types of transitory visual effects. For example, in those embodiments wherein an image is formed by groups of adjacent pattern elements (or portions of pattern elements) having a greater depth than the surrounding background-forming pattern elements, plural images or changing images may be formed of pattern elements of respectively different depths (greater than the depth of the background elements); in an illustrative case, successive images or image portions appear as the angle of view is progressively reduced, the first-appearing images or image portions being those formed by the pattern elements of greater depth. Continuous variation in depth of imageforming pattern elements can produce an appearance of animation or an illusion of motion as the angle of view is progressively reduced. By appropriate orientation of imageforming pattern elements, plural images can be provided which appear only when seen in respectively different directions of view, i.e., at acute angles of view. Like effects can also be achieved by use of appropriate plural different (or progressively changing) orientations of pattern elements, i.e., in those embodiments wherein contrast between a background and latent image is achieved through use of pattern elements having different orientations.

Although such variations and modifications are embraced within the invention in its broader aspects, particular advantages of the invention in a specific sense reside in the provision of intaglio imprints, incorporating transitory (i.e., latent or transient) images, that can rapidly and positively be verified even by untrained personnel by the simple operation of progressively changing the angle of view of the imprint thereby to cause variation in contrast between image and background, the image blending substantially with the background at one angle of view but appearing in clear contrast to the background at another angle of view. To facilitate such inspection, the imprint may be so arranged that this variation in contrast occurs in correspondence with changing angle of view in a plane perpendicular to a straight edge of the paper or other substrate bearing the imprint. Thus the person inspecting the document will have it properly oriented for examination when he holds it with that edge facing him. Alternatively, the presence of the transitory image may be detected by varying the angle of appropriately oriented illumination on the imprint.

Since the transitory images of the present invention are achieved through utilization of the depth property of intaglio printing, they cannot be reproduced, at least as transitory images, on photographic or other two-dimensional copies of the imprint. Even a photocopy reproducing the imprint with perfect fidelity as seen from a normal angle of view will exhibit no perceptible change in contrast between the image and background portions of the imprint with change in angle of view or angle of illumination, because the photographic copy is essentially a two-dimensional reproduction, lacking the physical property of depth that characterizes the original intaglio imprint. In other words, if the imprint bears a transient image, a photocopy made from a normal angle of view may discernibly reproduce the image, but the image will not disappear upon tilting the photocopy as it would in the original imprint. A latent image will be substantially undetectable visually in a photocopy taken from a normal angle of view and will not become more perceptible upon tilting of the photocopy.

As a further feature of advantage, the present invention in specific aspects affords provision of transitory images, facilitating rapid verification of documents and detection of photocopied or like counterfeits, that may readily and conveniently be produced without presenting any problem of register or other fabrication difficulty, owing to the fact that they may be incorporated in a single intaglio imprint, i.e. obtained by a single impression from a suitably engraved intaglio plate, although imprints embodying the invention may also be produced by plural successive impressions. Also, the invention affords transitory images requiring no special lighting or auxiliary detecting devices for detection, although again, as stated above, the invention may be embodied in forms adapted for use with particular illumination or detecting equipment. The images of the invention may be incorporated in the imprints on any kind of security paper or the like where intaglio printing is required or preferred.

The invention further comtemplates the provision of an intaglio plate for forming an imprint including one or more transitory images, such plate having engraved therein suitably arranged and dimensioned pattern elements for forming at least one image and background portions of an imprint as decribed above. In addition, the invention contemplates the provision of a method of forming a transitory image by intaglio printing, comrising impressing on a suitable substrate surface (in at least many cases preferably as a single impression) background and image-forming intaglio pattern elements having the above-described features of arrangement and relative depth or orientation.

Further features and advantages of the invention will be apparent from the detailed description hereinbelow set forth, together with the accompanying drawings.

BRIEF DESCRIPTION OF THE DRAWINGS

FIG. 1 is a plan view (i.e. taken from a normal angle of view) of an intaglio imprint embodying the present invention in a particular form;

FIG. 2 is a somewhat diagrammatic view of the imprint of FIG. 1, illustrating the appearance of an intaglio image therein at an acute angle of view;

FIG. 3 is an enlarged schematic sectional view taken along the line 3—3 of FIG. 1;

FIG. 4 is another enlarged schematic sectional view taken along the line 4—4 of FIG. 1;

FIG. 5 is a plan view of another embodiment of the invention;

FIG. 6 is a plan view of an intaglio imprint similar to that of FIG. 5, but somewhat simplified, again embodying the invention;

FIG. 7 is an enlarged schematic perspective view taken as along the line 7—7 of FIG. 6;

FIG. 8 is a somewhat diagrammatic perspective view of the imprint of FIG. 6 illustrating the appearance of the image at an acute angle of view;

FIG. 9 is a plan view of yet another intaglio imprint embodying the invention;

FIG. 10 is an enlarged and somewhat schematic sectional view taken along the line 10—10 of FIG. 9;

FIG. 11 is a somewhat diagrammatic perspective view of the imprint of FIG. 9 illustrating the appearance of the image at an acute angle of view;

FIG. 12 is a plan view of another intaglio imprint embodying the invention and incorporating a transient image;

FIG. 13 is a somewhat diagrammatic perspective view of the imprint of FIG. 12 illustrating the disappearance of the transient image at an acute angle of view;

FIG. 14 is an enlarged schematic sectional view taken along the line 14—14 of FIG. 12;

FIG. 15 is an enlarged schematic sectional view taken along the line 15—15 of FIG. 12;

FIGS. 18 and 19 are enlarged diagrammatic section views of a row and column respectively of an intaglio dot pattern conforming to the schematic arrangement of FIG. 17; and FIG. 20 is a somewhat diagrammatic plan view of an alternative intaglio dot pattern illustrating the formation of plural transient images according to the invention.

DETAILED DESCRIPTION

Figure 16:
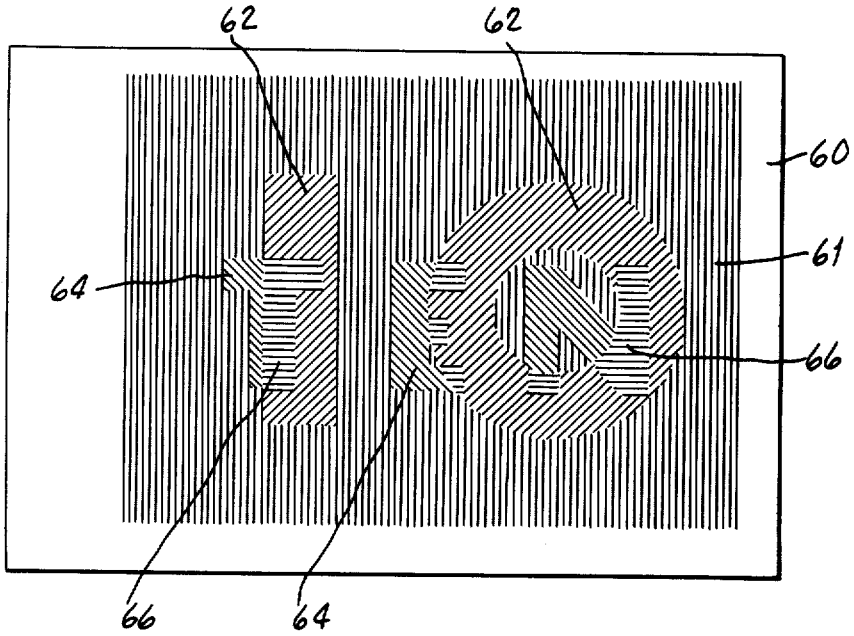
FIG. 16 is a somewhat diagrammatic plan view of an intaglio imprint illustrating the formation of plural latent images in accordance with the invention.

For purposes of illustration, the invention will be described as embodied in dark intaglio imprints on light paper wherein the intaglio pattern elements forming both the image and background portions of the imprint are substantially parallel spaced and raised inked intaglio lines. It will be understood, however, that the invention also embraces other combinations of ink and substrate or ground shade, e.g., a light intaglio ink on a dark background, and that the imprints of the invention may employ types and arrangements of pattern elements other than parallel lines.

In all the embodiments now to be described, a useful range of frequencies for the pattern elements (as conventionally defined in terms of line frequency) is between about 5 and about 1,000 lines per inch, a range of between about 100 and about 200 lines per inch being convenient and presently preferred in many instances.

FIGS. 1–4

The printed article of the invention in this embodiment is shown as a document of value including an intaglio imprint 10 impressed on one surface of a sheet of paper 11 and incorporating a latent image 12 formed by intaglio line portions having greater depth than the line portions forming the background 15 of the imprint.

As illustrated in FIG. 1, the imprint 10 consists of a large plurality of closely spaced intaglio lines 14 all identical in width (as seen from an angle of view normal to the surface of paper 11), spacing and orientation.

As viewed normally to the paper 11, the imprint has the appearance of a uniform array of lines, and the image 12 blends with the background 15 so as to be substantially undetectable visually, the dotted lines in FIG. 1 being provided simply to show the locations of the image portions of the imprint and not to indicate visibility of the image from the angle of view normal to the surface of the paper 11.

In the background portion 15 of the imprint, the lines 14 are of uniform depth. The lines passing through the image areas 12, however, include portions **14*a* within those image areas that have a substantially greater depth than the lines 14 outside the image area. Each of the lines 14 that passes through one or more images areas 12 also passes through, and constitutes part of, the background of the imprint, i.e., outside the image areas; therefore (as best seen in FIG. 4) even such a line includes portions 14*b* (outside the image areas) having the same depth as the other lines 14 in the background of the imprint, as well as portions 14*a* which are raised, i.e., of greater depth, coincident with the image areas and constituting the image. Stated in other words, and as hereinafter further described, the image 12** is constituted by the cooperative effect of locally raised portions 14*a* (i.e., portions of greater depth, as compared with the background lines) of a series of adjacent lines 14 within the imprint. In the illustrated imprint, these raised portions 14*a* are located within areas forming the capital letters ABCD, which letters comprise the image array in the embodiment of FIGS. 1–4. All the other portions of lines 14 comprise the background array.

As viewed in a direction perpendicular to the lines 14, e.g., along a line of sight contained within a plane X—X (FIG. 1) perpendicular to the imprinted surface of paper 11 and to the lines 14, the letters ABCD become increasingly visible as the angle of view L (FIG. 2) decreases in the plane X—X, i.e., from 90°. At a sufficiently acute angle of view, the image letters ABCD stand out in clear contrast to the background 15, as indicated in FIG. 2 which shows an image as it appears to an eye at the position 17 in FIG. 2, looking along a line of sight 18 (in plane X—X) that forms a very acute angle of view L with the plane of the imprinted surface of paper 11. It is to be understood that the image 12 is shown in FIG. 2 as it would appear to an eye at the aforementioned position 17 and not as it would appear to a person looking at the imprint from the end edge 20 of the paper.

The increase in contrast between image and background portions of the imprint 10, perceived as the angle of view L becomes increasingly acute, may best be explained by reference to FIG. 3, which schematically illustrates the image and background line portions in transverse cross section. Since these image and background line portions are of uniform width, there is little or no contrast between them when the imprint is viewed from a direction normal to the paper, i.e., with a 90° angle of view, and therefore the image blends with and is substantially indistinguishable from the background as thus normally viewed. However, owing to the depth of the lines 14 and 14*a*, when the imprint is viewed from an acute angle of view L, the dark-inked lines 14 and 14*a* partially occlude the unprinted spaces between the lines of the surface of the paper; hence there is a decrease in the amount of light or unprinted space visible between the lines, and a consequent darkening in the appearance of the imprint. Owing to the fact that the image-forming line portions 14*a* have a greater depth than the background-forming line portions, these image-forming line portions occlude relatively more of the adjacent unprinted spaces than do the background-forming line portions, at any given acute angle of view L in plane X—X. Therefore, as the angle of view L becomes progressively more acute, the image areas of the imprint become perceptibly darker in appearance than the background portions, enabling the image to be discerned visually (by contrast with the background) with increasing clarity. The broken line arrows in FIG. 3 illustrate this principle schematically. These arrows, representing a line of sight at a given acute angle of view L, shows that, when the angle L is such that the image-forming line portions 14*a* virtually completely occlude the intervening unprinted spaces 22 between them, the background line portions 14 still only partially occlude the intervening unprinted spaces; at such angle, then, the image is much darker than the background and is very clearly visible in sharp contrast to the background.

An image formed as shown in FIG. 1 can readily be detected upon rapid inspection. Since the lines 14 are aligned with a long edge 24 of the paper, a viewer inspecting the paper holds it with that long edge facing him, and tilts it progressively (thus changing the angle of view) to see if the image appears. The image can also be detected by changing the angle at which the image is illuminated, e.g. in the plane X—X, since at acute angles of incidence of illumination the relatively deep image-forming line portions 14*a* will cast longer shadows than the relatively less deep background-forming line portions, and this difference in shadow length will again create a dark and light contrasting pattern defining the image.

The imprint 10 containing the latent transitory image 12 may be formed on the paper 11 by generally conventional intaglio printing in a single impression from an appropriately engraved plate. The plate is an engraved or etched intaglio plate, i.e. having formed therein by etching or engraving an array of parallel grooves corresponding to the intaglio lines to be printed and including grooves having a relatively greater depth in the portions which are to from the image of the imprint. This plate may be prepared by any suitable and e.g. conventional means as will be apparent to those skilled in the art.

Specifically, the engraved intaglio plate having the described grooves including locally deepened portions in the image-forming areas, is inked by applying to its surface an ink of a type suitable for intaglio printing and then wiping the surface clean, leaving the ink deposited in the grooves thereafter, a sheet of paper to be imprinted is pressed against the plate so as to be deformed into the grooves and to receive the ink therefrom, providing on the paper surface the above-described imprint of raised intaglio lines. In this way the image and background portions of the imprint are simultaneously printed on the paper in a single printing operation The plate has the appearance of the imprint of FIG. 1, except that the plate has grooves where the imprint has ridges. Details of operating technique may as stated be generally conventional and need not be described, as they are well known to those skilled in the art. It will further be recognized that an imprint embodying the invention in the forms shown in FIGS. 1–4 may include a substantially larger number of lines per unit length than is illustrated.

It wil be appreciated that the concept of latent intaglio image formation by variation in pattern element depth, may be embodied in many different kinds of imprints. For example, imprints can be provided having plural images that appear successively as the angle of view is reduced in a given plane. Referring to FIGS. 1–4, if the image letters ABCD are respectively formed by line portions of decreasing depth, they will appear in succession as the angle of view is decreased in the plane X—X; the image letter A formed by line portions of greatest depth will appear first, i.e. at the greatest angle of view, and will remain visible as the image letter B (formed by line portions of next greatest depth) appears with decrease in angle of view, and so forth, until at a sufficiently acute angle of view all four letters are visible. The same effect can be employed to progressively amend an image with decrease in angle of view; thus (as a simple illustration) if the pattern elements (line portions) forming the straight portion of the image letter B in FIGS. 1–4 are deeper than the pattern elements forming the curved portions of that letter, the image will appear as the letter I or numeral 1 at a first acute angle of view in plane X—X, and change to the letter B upon decrease in angle of view.

Again, plural images may be formed which respectively appear only when the imprint is viewed (at an acute angle) from different directions. As a simple illustration, if in FIG. 1 lines including portions of enhanced depth forming the image letters C and D are oriented at an angle (e.g. a right angle) to the lines having portions forming letters A and B, then the imprint as viewed at an acute angle in a direction perpendicular to the last-mentioned lines will display only the letters A and B; but if the direction of view is changed so as to be perpendicular to the lines having portions forming letters C and D, than only those letters will appear at an acute angle of view.

The foregoing plural-image arrangements, described in simplified form, may be combined and modified to produce more complex and subtle transitory image effects. Thus, for instance, images displaying apparent animation or an illusion of motion may be provided, e.g. by employing arrangements of pattern elements that vary progressively and more or less continuously in depth over the image areas of the imprint.

The embodiment of FIGS. 1–4 is shown as employing parallel lines of uniform width as the intaglio pattern elements forming both the latent image and background of the imprint. The lines, however, may depart from parallelism and may vary in width, for example to provide patterns visible e.g. from an angle of view normal to the imprinted substrate surface. Alternatively, other types of pattern elements may be employed, e.g. broken lines or rows of dots corresponding to the lines of FIGS. 1–4 and having variation in depth to provide the latent image in the same manner as the lines shown in the drawing, or other arrangements, including random arrays, of pattern elements, wherein groups of adjacent pattern elements or portions thereof have relatively enhanced depth to cooperatively provide one or more latent images visible at a sufficiently acute angle of view in at least one plane normal to the substrate surface.

The transitory image of the imprint of FIGS. 1–4 cannot be reproduced by photocopying or like two-dimensional copying techniques. If, for example, the imprint is photographically copied at an angle normal to the imprinted surface, the photographically formed reproduction will be simply a uniform pattern of parallel lines, in which the image will be substantially undetectable visually as it is when the original imprint is viewed from a normal angle of view, and will display no increase in contrast between image and background portions as the angle of view is changed. While the imprint might be photographed at an appropriate angle or with illumination incident at an acute angle so as to reproduce the image, nevertheless the image on a photocopied or other two-dimensional reproduction would again not vary in contrast with the background upon change in angle of view, because two-dimensional copying is incapable of reproducing the variations in line depth that provide the transitory character of the image. Consequently, the authentic intaglio imprint can readily be distinguished from a two-dimensional counterfeit by visually ascertaining whether the image (if any) varies in contrast with the background as the angle of view or angle of illumination is changed. Thus, positive verification of a document bearing such imprint can be simply effected by relatively untrained personnel and without resort to auxiliary viewing devices.

FIGS. 5–8

In these embodiments of the invention, a latent image is formed by a first array of substantially parallel intaglio lines extending at a substantial angle (e.g., about 30° or more) to a second array of substantially parallel intaglio lines (e.g., similar to the image-forming lines in spacing and depth) forming the background portion of an intaglio imprint. Stated in general, the contrast attainable between image and background increases with increasing angular divergence between the image-forming lines and the background-forming lines, i.e., if other factors such as line depth and spacing and ink and background colors remain the same. The greatest contrast, then, is realized when the difference in orientation between the image lines and the background lines is 90°. For simplicity of illustration, the embodiments of the invention now to be described are shown as having image-forming lines perpendicular to the background-forming lines, as a specific example of the formation of latent images by divergent orientation of image and background lines.

Referring to FIG. 5, there is shown an intaglio imprint 30 on a sheet of paper 31. The imprint 30 comprises a centrally disposed maple-leaf image 32 formed of substantially parallel, closely spaced, raised and inked intaglio lines 33 extending in a direction substantially perpendicular to the long edge 34 of the paper. The imprint 30 further includes a background 36 (surrounding image 32) formed of substantially parallel, closely spaced, raised and inked intaglio lines 37 extending in a direction substantially parallel to the long edge of the paper, i.e., substantially perpendicular to the image-forming lines 33. The width and spacing of the background-forming lines 37 correspond to the width and spacing of the image-forming lines 33 so that the image and background portions of the imprint exhibit the same tone as seen from a normal angle of view; consequently, from that angle, the image blends with and is not readily distinguishable visually from the background.

In the imprint of FIG. 5, the lines of both the image and background portions are locally curved to provide variations in line spacing and thereby to form a pattern, visible from a normal angle of view, extending continuously through the latent image 32 and background 36. This visible pattern may be formed by lines of any orientation having appropriately located variations in spacing, since it is the arrangement of such variations (rather than the orientation of the line elements) that provides the visual effects cooperatively constituting the pattern; hence portions of the pattern may be defined by the background lines 37, and other portions of the same continuous pattern may be defined by the differently oriented image lines 33, without disrupting the continuity of the pattern. While this visible pattern may serve one or more of the usual purposes of a conventional visible intaglio pattern, e.g., conveying information or providing a decorative effect, this particular visible pattern also aids in concealing the latent image 32 when the imprint 30 is viewed from a direction normal to the surface of paper 31.

Notwithstanding the local curvature of the image and background lines in the imprint 30, it will be appreciated that all the background lines extend substantially in the same direction, and all the image lines extend subtantially in a direction perpendicular to the background lines. Because of this relative orientation of the image and background lines, the image 32 appears in perceptible contrast to the background 36 as the angle of view of the imprint becomes increasingly more acute. The relationship between image-background contrast and angle of view in the embodiment of FIG. 5 may be explained by reference to FIGS. 6 – 8, wherein (for simplicity of illustration) the background and image lines are shown as rectilinear, i.e. with the pattern-forming curves and variations in spacing omitted. It will be understood that the local pattern-producing variations in the lines of the FIG. 5 imprint do not significantly affect the image-background contrast at low angles of view.

As stated above, when viewed in a direction normal to the imprinted surface of paper 31, there is substantially no visually detectable contrast between the image 32 and background 36, because the line widths and spacings in the image and background portions are substantially the same; i.e. there is substantially the same ratio of ink-bearing area to visible "white space" (between lines) in the background as in the image. As viewed in a direction perpendicular to the background lines 37, the background 36 becomes darker with decreasing angle of view, owing to the fact that the raised and inked background lines 37 increasingly occlude the light or unprinted spaces between them as the angle of view becomes more acute. However, the defined direction of view (perpendicular to the background lines 37) is substantially aligned with the image lines 33; hence decrease in angle of view in this direction does not cause progressive occulsion of the light spaces between the lines of the image, but instead these light spaces remain fully visible even at very acute angles of view. As a result, at a sufficiently acute angle of view the image is very markedly lighter in appearance than the background, and stands out in clear contrast thereto, i.e. because the image remains relatively light in appearance while the background darkens progressively with decrease in angle of view.

FIG. 7 is an enlarged, schematic perspective view of adjacent image and background portions as they appear at an acute angle of view in a plane perpendicular to the paper edge 34 and to the background lines 37. This figure illustrates the occlusion of intervening light spaces in the background by the lines 37, and the continuing visibility of the light spaces between the image lines 33, at this angle of view. FIG. 8 shows the image 32 and background 36 as they would appear to an eye at the position 39 looking toward the image in a plane perpendicular to paper edge 34, at an acute angle of view L.

A reverse effect is observed if the imprint 30 is viewed in a direction perpendicular to the image lines 33 (and thus aligned with the background lines 37); i.e. the image then becomes progressively darker in appearance as the angle of view becomes more acute, owing to occlusion of the light spaces in the image by the image lines, while the background remains relatively light, with the result that at a sufficiently acute angle of view the viewer sees a dark image standing out in contrast to a light background.

Contrast between image and background can also be perceived by using directional illumination of the image at an acute angle perpendicular to either the image lines or the background lines, for selective darkening of the image or background portion by shadows cast by the raised lines in such portion.

It will thus be appreciated that the authenticity of an intaglio imprint incorporating a latent image of the type shown in FIGS. 5 – 8 can readily be verified by tilting the paper bearing the imprint to change the angle of view, in a direction perpendicular to either edge of the paper, or alternatively by changing the angle of illumination of the imprint. In an authentic imprint, an image will appear, increasing in contrast with decrease in angle of view or illumination. Although a photographic copy of the imprint may be able to reproduce the lines forming the image, e.g. as they appear when viewed in a direction normal to the surface of the paper, the image in a photocopied or other two-dimensional counterfeit will be substantially undetectable visually and will not appear upon change in angle of view or illumination; i.e. it will no exhibit the change in contrast with the background because the photocopy cannot reproduce the transitory quality of the image, which is dependent on the three-dimensional character of intaglio printing.

Preferably, to facilitate detection, the transitory image is either a letter, a number, a combination of letters and/or numbers, or an easily recognizable symbol such as (in FIGS. 5 – 8) a maple leaf, as the recognizable shape of the image may enhance the ease with which it is perceived.

Although the intaglio pattern elements shown in the embodiments of FIGS. 5 – 8 are lines, other spaced and raised inked pattern elements may be used, such as (for example) discontinuous or broken lines or appropriately oriented rows of dots, in place of the lines. Also, while the surface of the paper should be in contrast with the ink of the intaglio pattern elements, the surface need not be white, but may be tinted and/or surface printed (e.g. in a light ink, when a dark intaglio ink is used, or a dark ink, when a light intaglio ink is used) with a ground pattern. As noted, the image lines or other pattern elements need not be oriented perpendicularly to the background lines or other pattern elements; although the greatest contrast is achieved with such perpendicular orientation, usefully discernible contrast between image and background is achieved (at a sufficiently acute, properly oriented angle of view) when the difference in orientation between image and background lines is much less, e.g. as little as 30°.

Plural images, for example images visible at acute angles of view from respectively different directions of view, may be achieved by providing, in a single imprint, an appropriate plurality of image-forming and background-forming pattern element orientations. An example is described below with reference to FIG. 16. Further special effects may be produced by using continuously or progressively changing line orientations, e.g. to provide a latent image that alters in appearance (from an acute angle of view) as the direction of view is changed. Moreover, the production of latent images by differing pattern element orientations may be combined with other image-producing arrangements (such as variation in pattern element depth) in accordance with the invention to provide still more complex transitory visual effects.

Typically, an intaglio line imprint of the type illustrated in FIGS. 5 – 8 may be made up of 100 or more lines to the inch. The contrast attainable between image and background is dependent on the angle of view, the depth of the individual lines, and the spacing between them. More specifically, the angle of view L (in a plane perpendicular to a paper or like surface and to an array of parallel intaglio lines printed thereon) at which the lines completely occlude the light spaces between them may be defined by the relation $$L = \arctan (a/b) \quad (1)$$

wherein $a$ = line depth (embossment plus ink film), and $b$ = width of light space between adjacent lines.

For a given number $n$ of lines per inch, and a given ratio $r$ of inked to uninked space per unit area of the imprint (a commonly used parameter in intaglio printing), again assuming the case of parallel intaglio lines of uniform width, $$b = [1/n(r+1)] \quad (2)$$

thus when $n$ and $r$ are known, the line depth ($a$) required to achieve complete occlusion of intervening spaces (and hence full visibility of latent image) at a given angle of view is $$a = [\tan L/n(r+1)] \quad (3)$$

By way of specific example, for complete occulsion at a 5° angle of view, the ratio $a/b$ (equal to tan 5°) must be 0.087; for complete occlusion at 12°, $a/b$ must be 0.208; and for complete occulusion at 20°, $a/b$ must be 0.364. In other words, for complete occulsion at a 12° angle of view the line depth must be about 1/5 the width of the light space between lines; thus for $n = 50$ lines/inch and $r = 1:1$, $b = 0.01$ inch and the line depth (a) must be 0.002 inch, while for $n = 200$ lines/inch and $r = 1:1$, $b = 0.0025$ inch and the requisite line depth is only 0.005 inch. The foregoing examples illustrate the way in which line depth can be calculated to produce a desired latent or transient image effect in this and other embodiments of the invention.

As in the case of the embodiment of FIGS. 1 – 4, the imprint of FIGS. 5 – 8 may be formed on a sheet of paper or like substrate from a suitably engraved and inked intaglio plate in a single impression, using generally conventional intaglio printing techniques. The engraved or etched pattern on the plate (i.e. incised into the otherwise smooth plate surface) has the same appearance as the imprint shown in FIG. 5 except that the lines 33 and 37 on the plate are grooves rather than raised embossments. In general, the grooves on the plate should be somewhat deeper than the desired line depth (i.e. height of line relief) on the imprint to be produced. As will be understood by those skilled in the art, the depth of relief attained in an intaglio imprint for a given depth of engraving on a plate is dependent, inter alia, on the properties of the substrate being printed, such as the hardness of paper (when paper is used as the substrate); in other words, the depth of engraving of the plate (to produce a desired line depth in the inprint) is determined with reference to the properties, such as hardness, of the substrate that is to be printed. When the plate is inked (with ink deposited in the engraved recesses of the plate, and wiped from the smooth plate surface), and the paper to be printed is pressed against it, the image and background are simultaneously imprinted as raised, inked lines on a surface of the paper, the paper being deformed into the grooves of the engraving to form raised ridges and the ink from the grooves being deposited on the ridges to produce the raised and inked intaglio imprint. The plate may be engraved or etched, and the design of background lines (or other pattern elements) and substantially differently oriented image lines (or other pattern elements) to be engraved may be initially prepared, by known techniques as will be apparent to those skilled in the art.

FIGS. 9 – 11

The embodiment of the invention herein illustrated includes an intaglio imprint 40 (on a sheet of paper 41) which incorporates a latent image 42 similar to that of FIGS. 5 – 8, i.e. formed of parallel intaglio lines 43 extending in a direction perpendicular to an array of parallel intaglio lines 44 forming a background 45. However, in this embodiment both the image and background lines are substantially rectilinear. Local widening (shown at 46) and interruption (shown at 47) of both image and background lines produces an overall pattern of ovals extending continuously through the image and background without hindering perception of the image (the word TEN) in clear contrast to the background when the imprint is viewed at a sufficiently acute angle of view L in a plane perpendicular to one of the sets of parallel lines, e.g. perpendicular to the background-forming lines, as shown in FIG. 11. The pattern produced by widenings 46 and interruptions 47 of the two sets of lines is visible when the imprint 40 is viewed at an angle normal to the surface of the paper 41, and aids in making the latent image 42 substantially undetectable visually from that angle. Except for the way in which this pattern is formed, the embodiment of FIGS. 9 – 11 is generally similar to that of FIGS. 5 – 8.

FIGS. 12 – 15

These figures show a way of forming a transient image in accordance with the present invention, i.e. an image that is visible when seen from a 90° angle of view but which disappears when the angle of view becomes sufficiently acute.

In this embodiment, an intaglio imprint 50 on a sheet of paper 51 comprises a background 52 formed of parallel, spaced, raised and inked intaglio lines 53 e.g. of uniform depth, and a transient image 54 (shown as an arrow) formed of further intaglio lines 55 parallel with and interposed between lines 53 of the background. The image-forming lines 55 are substantially lesser in depth than the background-forming lines 53, as best seen in FIGS. 14 and 15.

When the imprint 50 is seen from a normal angle of view (i.e. 90° with respect to the paper surface), the image 54 is clearly visible in contrast to the background, because the visible image lines 55 darken the image portion of the imprint relative to the background portion wherein there are no printed lines in the light spaced between adjacent background lines 53. However, at a sufficiently acute angle of view L (i.e. with a direction of view perpendicular to the background lines 53), the deeper background lines 53 completely occlude the less deep image lines 55 as well as the light spaces between background lines, with the result that the image disappears and the imprint exhibits a more or less uniform dark tone. FIG. 13 illustrates the disappearance of the image from the imprint 50 as seen by an eye in position 58 at an acute angle of view L, while FIG. 15 shows diagrammatically the occluding effect of the background lines as seen along a line of sight 59 at angle L. Thus the transient character of the image may readily be perceived by tilting the paper 51 to change the angle of view. A photocopied or other two-dimensional counterfeit may reproduce the image lines 55 as well as the background lines 53, but will not exhibit this transient quality of the image because the photocopy cannot reproduce the requisite difference in image and background line depth to achieve the transitory effect.

The angle of view L at which the image disappears is dependent on the relative depths of the image and background lines as well as the spacing between adjacent background lines. It is presently preferred to select these dimensions to provide complete occlusion of the image lines (and consequent disappearance of the image) at a viewing angle of between about 5° and about 20°.

The image and background portions of the imprint 50 may be formed on the paper 51 in a single impression from an intaglio plate having etched or engraved thereon an array of grooves respectively corresponding in depth and position to the background and image lines of the imprint. Such plate will have the appearance of the imprint shown in FIG. 12, except that, of course, the plate has grooves where the imprint has raised ridges.

Again, as in the other embodiments of the invention described above, the image and background may be formed of pattern elements other than continuous parallel lines.

FIGS. 16–20

FIGS. 16 to 20 inclusive illustrate the formation of plural images in accordance with the principles of the invention.

First referring to FIG. 16, a first latent image comprises the letters T, E and N and a second partially overlapping latent image comprises the numerals 1 and 0. The images are formed in a background line pattern shown arbitrarily as parallel, raised and spaced inked intaglio lines 61 printed on an appropriate substrate 60. The numerals 1 and 0 are formed as an intaglio imprint comprising, for non-overlapping areas 62, parallel, raised and spaced inked intaglio lines oriented in a direction diagonal to the background lines 61. The letters T, E and N are similarly formed as an intaglio imprint comprising, for non-overlapping areas 64, parallel, raised and spaced inked intaglio lines oriented in a direction perpendicular to the lines of areas 62, and again diagonal to the background lines 61. The problem in creating the plural image arises in areas 66 which are areas common to both the numerals 1 and 0 and the letters T, E and N. These areas are comprised of raised and spaced parallel inked intaglio lines having an orientation intermediate the orientation of the lines in areas 62 and 64 respectively; thus the lines in areas 66 may, as shown, have an orientation perpendicular to the background lines 61. The lines in areas 62, 64 and 66 are intaglio-printed in the same way as has been described above with reference to FIGS. 1 to 11.

Thus when a viewer views the pattern of FIG. 16 along a direction or viewing line perpendicular to the lines in image areas 62, at a small angle of view (i.e. angle to the plane of the substrate 60), the lines in areas 62 will merge together to form a clearly visible image of the greater part of the numerals 1 and 0. Furthermore, since along the last-mentioned viewing line there is some visual "compression" of the lines in areas 66, a visual merging effect will occur in these areas as well which, while less pronounced than the merging of the lines in areas 62 along this viewing line, nevertheless is sufficient to afford the viewer visual continuity of the numerals 1 and 0.

Similarly, when the pattern is viewed along a direction of view perpendicular to the lines of areas 64 at a slight angle to the surface of the substrate 60, the letters T, E and N will be readily perceived by the viewer. Again the areas 64 comprised of raised intaglio-printed lines oriented exactly perpendicularly to the line of viewing will give the most pronounced visual merging, but areas 66 will give sufficient visual merging to enable the viewer to see the letters T, E and N as continuously-formed discrete visual areas.

FIG. 16 thus illustrates the formation of plural latent images in accordance with the principles of the invention.

Figure 17:
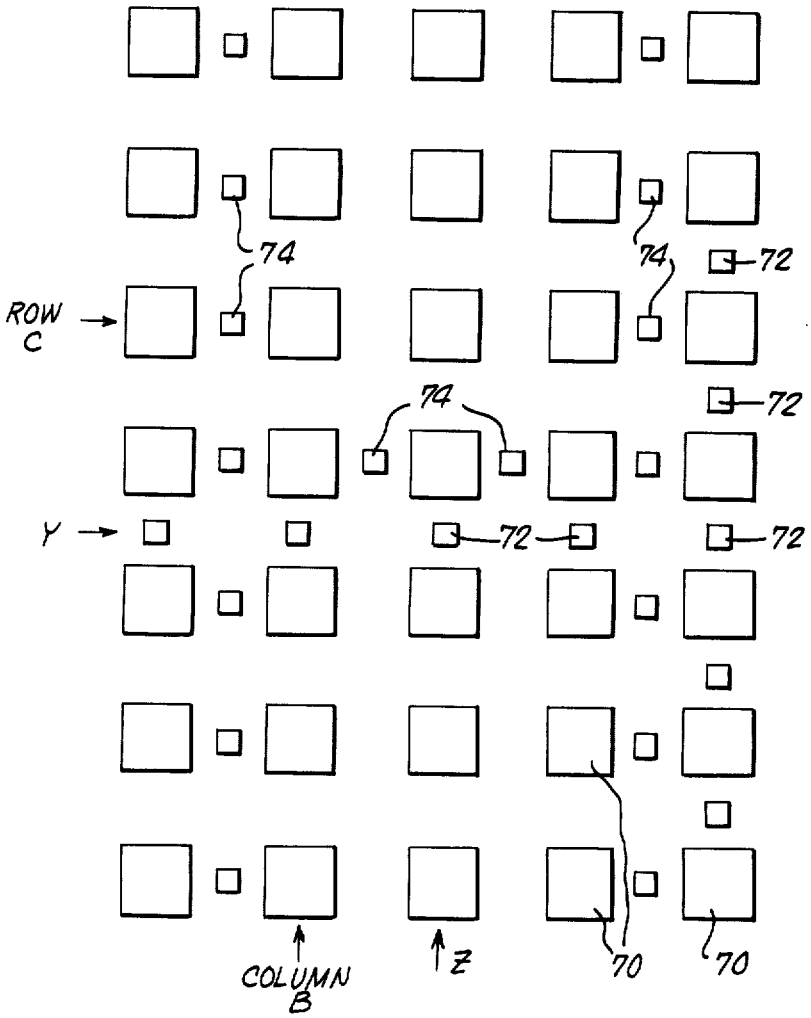
FIG. 17 is a greatly enlarged schematic plan view of an intaglio dot pattern illustrating the formation of plural transient images according to the invention.

FIG. 17 illustrates schematically in greatly expanded view a pattern for the formation of plural transient images in accordance with the invention. The printed pattern comprises a first set of spaced and raised inked intaglio dots of a first height above the substrate level arranged in an appropriate array, for example a rectangular array, i.e. in vertical columns and horizontal rows as seen in FIG. 17. These dots are shown schematically as the large squares 70 in FIG. 17. Between these large dots 70 are intermediate spaced and raised linked intaglio dots of a lower height which are strategically placed in order to form transient images in two different viewing directions. A first set of intermediate dots 72 forming arbitrarily the letter T are individually aligned with the columns of larger dots 70. Another set of intermediate dots 74 forming arbitrarily the letter H are individually aligned with rows of the larger dots 70. When the pattern is viewed along direction Z at a slight angle to the plane of the pattern, dots 72 will be occluded by dots 70 and the viewer will not see the letter T. When the pattern is viewed along direction Y at a slight angle to the plane of the pattern, dots 74 will be occluded by dots 70 and the viewer will not see the letter H. However, when the pattern is viewed from a direction perpendicular to its plane, the proximity of components of each letter may create visual confusion at such angle. The "confusion" can, of course, be artistically arranged to have eye appeal in appropriate patterns.

It will be understood that the representation of FIG. 17 is schematic only in showing large and small squares to illustrate two different heights of the raised intaglio dots 70, 72 and 74, but in the interests of lucid description and having regard to the limitations of a two-dimensional presentation of the invention, this approach to description has been adopted. Since FIG. 17 is schematic in nature, FIGS. 18 and 19 have been added to show, in expanded view, the cross section of a representative row and a representative column of the pattern components of FIG. 17. FIG. 18 is a cross section of row C and FIG. 19 a cross section of column B. It will be seen that the intermediate dots 74 (FIG. 18) and 72 (FIG. 19) have a height less than the height of the dots 70 forming the rectangular array. The dots 72 and 74 need not necessarily be smaller in surface area than the dots 70 but they should be small enough to be completely occluded by the appropriate dot 70 when viewed in that direction which makes the transient image disappear.

FIG. 20 illustrates in expanded view a variant of the plural transient image technique of FIG. 17. In FIG. 20, all the dots in the pattern are of the same size and all the same height. However, the orientation of selected dots has been chosen so that in one of two perpendicular directions one transient image tends to diminsh in visual impact when the pattern is viewed at a slight angle to its plane and in the other of the two perpendicular directions, another transient image likewise tends to disappear, although both transient images appear, albeit in rather less obviously perceptible form, when the document is viewed perpendicularly to its plane. The transient visual effect of the plural images of FIG. 20 is less pronounced than that of the FIG. 17 technique.

In FIG. 20, a rectangular dot array comprised of individual raised and inked square intaglio dots 80 is arranged on the substrate (in vertical columns and horizontal rows) so that each dot 80 is separated from its nearest dot neighbors 80 by a horizontal and a vertical space equal to its width. A first set of additional dots 82 identical to dots 80 is arranged so that the dots 82 are aligned with columns of dots 80. The dots 82 form the letter A, turned on its side as viewed in FIG. 20. A second set of dots 84 identical to dots 80 is individually oriented in line with rows of dots 80 to form the letter C. The distinguish the three sets of dots shown on the drawing from one another, the dots have been individually drawn as bearing three different types of surface pattern, according to the set to which they belong. However, it is to be understood that in the pattern as printed, the dots would be a solid color. Indeed, if the dots 80, 82, 84 are exactly uniform in area and the space between dots 80 is equal to or less than the width of a dot, the dots 82 and 84 will merge with dots 80 to form solid line patterns.

When the pattern of FIG. 20 is viewed in direction Z, at a slight angle to the pattern plane, there is visual merging of horizontal lines but not of vertical lines, and thus the letter C formed by dots 84 become visually prominent while the letter A tends not to be perceived. When the pattern is viewed in direction Y at a slight angle to the pattern plane, there is visual merging of vertical lines but not horizontal lines, and thus the letter A formed by dots 82 becomes visually prominent while the letter C tends not to be perceived. Viewed from a perpendicular direction, the pattern shows the combined set of vertical and horizontal lines forming the letters A and C in equal degree of visual impact.

While FIGS. 16 – 20 have illustrated only two plural images and have thus made use of two dot or line orientations at 90° to one another, it will be apparent that more than two plural images can be created using line or dot orientations of smaller angular difference. For example, three plural images could be created using three orientations at angles differing by 60° from one another. In the 60° example, the overlapping areas of two latent images of FIG. 16 could be intaglio printed with raised and inked lines running at 30° to the orientation of each of the two non-overlapping raised and inked line areas of the two latent images.

Intaglio plates for printing the patterns of FIGS. 16 – 20 may be created using similar dimensions, spacings, etc. as those previously described above.

It is to be understood that the invention is not limited to the features and embodiments hereinabove specifically set forth but may be carried out in other ways without departure from its spirit.

We claim:

1. A security document or the like, comprising:

a. a substrate having a surface;

b. an imprint comprising spaced pattern elements raised from said surface, said raised elements being inked with a color visibly contrasting with the intervening portions of said surface, said intervening portions being visible between said pattern elements when viewed along a line of sight perpendicular to said surface;

c. said imprint including at least one image array and a background array, each array comprising a multiplicity of said pattern elements;

d. said image array and said background array being respectively disposed, in relation to said surface, for occluding their respective intervening portions of the surface in different degrees as the imprint is viewed at an oblique angle in at least one plane normal to said surface, thereby to produce variation in contrast between said one image array and said background array as the angle of view of said imprint varies in said one plane normal to said surface, the image and background arrays being further respectively so disposed that said one image array blends substantially with said background array from one angle of view but appears in clear contrast to said background array from another angle of view in said plane.

2. A document as defined in claim 1, wherein said pattern elements in said background array are substantially parallel lines, and said pattern elements in said image array are substantially parallel lines extending at a substantial angle to the lines in said background array, for providing increase in contrast between said image array and said background array with decrease in angle of view in a plane substantially perpendicular to either the image lines or the background lines.

3. A document as defined in claim 2, wherein the lines in said image array are of substantially the same width and spacing as the lines in said background array, so that said image array blends substantially with said background array when said imprint is seen at a 90° angle of view.

4. A document as defined in claim 3, wherein the pattern elements in both said image array and said background array are shaped and disposed to define cooperatively a pattern that extends continuously through said image array and said background array and is visible then said imprint is seen from a 90° angle of view.

5. A document as defined in claim 4, wherein said pattern is formed by local variation in spacing between adjacent lines.

6. A document as defined in claim 4, wherein said pattern is defined by local variations in width of said lines.

7. A document as defined in claim 1, wherein said substrate has at least one substantially rectilinear edge, and said one plane is perpendicular to said one edge.

8. A security document or the like, comprising:

a. a sheet having a surface, b. an imprint comprising spaced pattern elements raised from said surface, said elements being printed with an ink having a color in visual contrast to the color of the surface, said elements being individually small in at least one dimension parallel to said surface, and closely and substantially regularly spaced for cooperatively producing an integrated visual impression of said imprint as viewed at an angle normal to said surface, said elements being separated by intervening narrow surface portions free of said ink and lower in elevation than said inked elements;

c. said imprint including at least one image area and at least one background area contiguous thereto, each of said areas containing an array of said elements;

d. the array of elements in said one image area cooperatively defining an image;

e. the array of elements in said one background area cooperatively defining the limits of said image;

f. the ratio of inked to ink-free surface in both said areas being substantially identical as viewed at said normal angle;

g. said image-defining array of pattern elements and said background defining array of pattern elements being respectively disposed, in relation to each other and to said surface, to occlude intervening ink-free surface portions in respectively different degrees as viewed at an oblique angle to the surface in at least one plane normal to the surface, for substantially reducing the ratio of inked to visible ink-free surface in one of said areas relative to the other of said areas as viewed at said oblique angle thereby to provide heightened visual contrast between said image and background areas as viewed at said oblique angle.

9. An article as defined in claim 8, wherein said elements of said image-defining array comprise lines extending generally in a first common direction, and wherein said elements of said background-defining array comprise lines extending generally in a second common direction oriented at an angle to said first direction.

10. An article as defined in claim 8, wherein said elements of both said image-defining array and said background-defining array are shaped for cooperatively defining a visible pattern extending continuously through said image and background areas as viewed at said normal angle.

11. A document of value, comprising:

a. a sheet of material having an intaglio-printable surface;

b. a multiplicity of spaced intaglio-printed pattern elements on said surface, said elements being printed with an ink having a color contrasting with the color of the intervening portions of the surface;

c. said elements being arranged in an image array and an adjacent background array defining the limits of the image array;

d. the elements of the background array having a dimensional characteristic differing from the corresponding dimensional characteristic in the elements of the image array;

e. the difference between said characteristics of the background and image arrays being detectable by comparison of visual inspections along two different preselected lines of sight, in one of which inspections the two arrays blend so as to be distinguishable only with difficulty, and in the other of which the two arrays appear in clear contrast.

12. A document of value as in claim 11, in which the pattern elements are lines, the dimensional characteristics are the orientations of the lines, and the orientation of the background lines is at an angle of at least 30° with respect to the orientation of the image lines.

13. A document of value as in claim 11, in which said dimensional characteristics are the depths of the intaglio-printed elements.

14. A document of value as in claim 11, in which said image array defines a readily recongizable symbol.

15. A document of value as in claim 11, in which the background array surrounds the image array and extends through areas enclosed by but not occupied by the image array.

16. A document of value as in claim 11, in which the pattern elements are dots arranged in parallel rows and parallel columns extending at an angle to one another, and the dimensional characteristics are the alignment of the image pattern elements with only the rows or the columns of the background pattern elements.

17. A document of value as in claim 11, in which the pattern elements are lines, the widths of the lines and of the intervening surface portions being such that there are from 100 to 200 lines per inch, measured in a direction perpendicular to the lines.

18. A document of value, comprising:

a. a sheet of material having an intaglio-printable surface;

b. a multiplicity of spaced intaglio-printed pattern elements raised from said surface, said elements being printed with an ink having a color contrasting with the color of the intervening portions of the surface;

c. said elements being arranged in an image array and an adjacent background array defining the limits of the image array;

d. the elements of the background array having a dimensional characteristic differing from the corresponding dimensional characteristic in the elements of the image array;

e. the difference between said characteristics of the background and image arrays being detectable by comparison of visual inspections along two different preselected lines of sight, in one of which inspections the two arrays blend so as to be distinguishable only with difficulty, and in the other of which the elements of one of the two arrays substantially completely occlude the intervening surface portions, while the intervening surface portions of the other array are substantially completely visible, so that said one array appears as a field having the color of the ink, and said other array appears as a field having a color between that of the ink and that of the intervening surface portions.

19. A document of value as in claim 18, in which the pattern elements are lines, the dimensional characteristics are the orientations of the lines, and the lines in the background make an angle of at least 30° with respect to the lines in the image array.

20. A document of value as in claim 19, in which said angle is 90°.

21. A document of value as in claim 18, in which the elements of the other array are located on the intervening surface portions of said one array, and are lower than the elements of said one array, so as to be occluded by aligned elements of said one array when the line sight is at a small angle to the plane of the surface.

22. A document of value as in claim 18, in which the pattern elements are lines, and the widths of the lines are locally varied to define an overall pattern extending continuously through the image and background arrays, said overall pattern being effective to inhibit distinguishing of the two arrays during said one inspection.

* * * * *